US009590320B2

(12) United States Patent
Zhang et al.

(10) Patent No.: US 9,590,320 B2
(45) Date of Patent: Mar. 7, 2017

(54) ELECTROMAGNETIC DIPOLE ANTENNA

(71) Applicant: Huawei Technologies Co., Ltd., Shenzhen, Guangdong (CN)

(72) Inventors: Wenxin Zhang, Shanghai (CN); Qihao Xu, Shanghai (CN); Hongli Peng, Shanghai (CN); Zehe Zhu, Shanghai (CN); Jianping Zhao, Xi'an (CN); Ni Ma, Shanghai (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 122 days.

(21) Appl. No.: 14/584,679

(22) Filed: Dec. 29, 2014

(65) Prior Publication Data

US 2015/0116173 A1 Apr. 30, 2015

Related U.S. Application Data

(63) Continuation of application No. PCT/CN2013/077783, filed on Jun. 24, 2013.

(30) Foreign Application Priority Data

Jun. 29, 2012 (CN) ..... 2012 1 0222545
Aug. 31, 2012 (CN) ..... 2012 1 0319106
Sep. 18, 2012 (CN) ..... 2012 1 0345654

(51) Int. Cl.
*H01Q 21/26* (2006.01)
*H01Q 1/36* (2006.01)
(Continued)

(52) U.S. Cl.
CPC ..... *H01Q 21/26* (2013.01); *H01Q 1/36* (2013.01); *H01Q 5/385* (2015.01); *H01Q 7/00* (2013.01); *H01Q 9/265* (2013.01)

(58) Field of Classification Search
CPC ..... H01Q 7/00; H01Q 21/28; H01Q 21/30
(Continued)

(56) References Cited

U.S. PATENT DOCUMENTS 3,918,063 A 11/1975 Nakamichi et al.
6,700,539 B2 3/2004 Lim
(Continued)

FOREIGN PATENT DOCUMENTS

CN 101587984 A 11/2009
CN 101752664 A 6/2010
(Continued)

OTHER PUBLICATIONS

Hong-Li Peng, et al., "A Compact Single/Dual-Polarized Broadband Antenna With SUM and Difference Beam Capabilities", IEEE Antennas and Wireless Propagation Letters, vol. 9, 2010, p. 990-993.

(Continued)

*Primary Examiner* — Dameon E Levi
*Assistant Examiner* — David Lotter

(57) ABSTRACT

An electromagnetic dipole antenna designed in the present invention includes an antenna radiating unit and a metal ground, where the antenna radiating unit mainly includes vertical electric dipole and horizontal magnetic dipole, where the vertical electric dipole and the horizontal magnetic dipole jointly form an electromagnetic coupling structure. The antenna has advantages of small size, low profile, and the like.

1 Claim, 6 Drawing Sheets

(51) Int. Cl.
*H01Q 5/385* (2015.01)
*H01Q 9/26* (2006.01)
*H01Q 7/00* (2006.01)

(58) Field of Classification Search
USPC ..... 343/725, 726, 727, 728, 729, 730, 797, 343/846, 848
See application file for complete search history.

(56) References Cited

U.S. PATENT DOCUMENTS

| | | | | |
|---|---|---|---|---|
| 6,956,529 | B1 | 10/2005 | Chen | |
| 7,190,310 | B2 | 3/2007 | Masutani | |
| 7,701,395 | B2 | 4/2010 | Alvey et al. | |
| 2006/0012535 | A1 | 1/2006 | McLean | |
| 2006/0255945 | A1* | 11/2006 | Egbert | G06K 19/07749 340/572.7 |
| 2007/0171132 | A1 | 7/2007 | Utagawa et al. | |
| 2009/0128442 | A1 | 5/2009 | Fujita et al. | |
| 2010/0253587 | A1* | 10/2010 | Lindenmeier | H01Q 7/00 343/797 |
| 2011/0025573 | A1* | 2/2011 | Payne | H01Q 21/26 343/797 |
| 2012/0007786 | A1 | 1/2012 | Ando et al. | |

FOREIGN PATENT DOCUMENTS

| | | | |
|---|---|---|---|
| CN | 101916910 | A | 12/2010 |
| CN | 201797047 | U | 4/2011 |
| CN | 102299420 | A | 12/2011 |
| CN | 102349192 | A | 2/2012 |
| CN | 102882004 | A | 1/2013 |
| CN | 202797284 | U | 3/2013 |
| EP | 1 617 515 | A1 | 1/2006 |
| EP | 2 081 256 | A1 | 7/2009 |
| JP | 05145319 | | 6/1993 |
| JP | 10290113 | A | 10/1998 |
| JP | 2005236873 | A | 9/2005 |
| JP | 2007150863 | A | 6/2007 |
| JP | 200879303 | A | 4/2008 |
| JP | 2012005146 | A | 1/2012 |
| RU | 2123459 | C1 | 12/1998 |
| RU | 2255399 | C2 | 6/2005 |
| RU | 2264005 | C1 | 11/2005 |
| RU | 2285984 | C1 | 10/2006 |
| WO | WO 00/19564 | A1 | 4/2000 |
| WO | WO 2005/124926 | A1 | 12/2005 |
| WO | WO 2011/040328 | A1 | 4/2011 |
| WO | WO 2012/092889 | A2 | 7/2012 |

OTHER PUBLICATIONS

Lam Siu, et al., "A Dual-Polarized Magneto-Electric Dipole With Dielectric Loading", IEEE Transactions on Antennas and Propagation, vol. 57, No. 3, Mar. 2009, p. 616-623.

Feng Bin, "Impact of base station antenna miniaturization brought", www.ttm.com.cn, Telecommunications Technology, 2011,7 pages.

* cited by examiner

ELECTROMAGNETIC DIPOLE ANTENNA

CROSS-REFERENCE TO RELATED APPLICATIONS

This application is a continuation of International Application No. PCT/CN2013/077783, filed on Jun. 24, 2013, which claims priority to Chinese Patent Application No. 201210345654.9, filed on Sep. 18, 2012, and Chinese Patent Application No. 201210319106.9, filed on Aug. 31, 2012 and Chinese Patent Application No. 201210222545.8, filed on Jun. 29, 2012, all of which are hereby incorporated by reference in their entireties.

TECHNICAL FIELD

The present invention relates to an electromagnetic dipole antenna, and in particular, to a miniaturized wireless antenna for a mobile communication system.

BACKGROUND

The rapid development and application of mobile communication technologies effectively promote the development of modern communication towards a direction of miniaturization, integration, and multifunction (multi-band, multi-polarization and multipurpose). An antenna is one of the most important parts in a wireless communication system, and the size of the antenna becomes one of bottlenecks that restrict further miniaturization of the communication system. Therefore, design of miniaturized, integrated and multifunctional antennas has currently become a focus of research of the antenna industry.

There are many documents about miniaturized multi-band antennas published at home and abroad, among which Influence of Miniaturized Base Station Antennas published in Information Technology on Dec. 25, 2011 is the most typical article. This article mainly introduces a tri-band base station antenna which can be applied at 806-960 MHz, 1710-2170 MHz and 1710-2170 MHz. The size of the antenna is 1340 mm×380 mm×380 mm. However, for a new communication system with an increasing demand for antenna miniaturization, the antenna is still oversized, and miniaturized antennas, especially miniaturized antennas with a low-profile feature, need to be further researched, so as to facilitate the deployment and installation of antennas.

A Dual-Polarized Magneto-Electric Dipole With Dielectric Loading is a paper published in IEEE TRANS ON AP, VOL. 57, NO. 3, MARCH 2009. The structure of an electromagnetic dipole antenna mentioned in the paper is shown in FIG. 1. FIG. 1 is a schematic diagram of an electromagnetic dipole antenna in the prior art, where the structure includes a conventional electric dipole 102 and an L-shaped magnetic dipole 103, 101 is a metal ground, and 104 is an interface through which a radio frequency electric signal passes through an SMA connector.

Although the antenna shown in FIG. 1 is of a large thickness, it is difficult to be processed.

SUMMARY

Embodiments of the present invention provide an electromagnetic dipole antenna, including an antenna radiating unit and a metal ground, where the antenna radiating unit mainly includes a vertical electric dipole and a horizontal magnetic dipole, where the vertical electric dipole and the horizontal magnetic dipole jointly form an electromagnetic coupling structure.

The present invention designs an electromagnetic dipole antenna which can be applied to a wireless communication system. The antenna is of a small size and a low profile, and can cover multiple bands and can also optimally cover a specific band.

The antenna provided in the present invention mainly includes an antenna radiating unit, a metal ground, and an electromagnetic coupling structure, where the electromagnetic coupling structure is arranged between the antenna radiating unit and the metal ground.

The antenna radiating unit includes a vertical electric dipole group and a horizontal magnetic dipole group, where electromagnetic coupling is implemented between the vertical electric dipole and the horizontal magnetic dipole through a dielectric. The metal ground may be of a planar ground structure and may also be of a non-planar ground structure.

The vertical electric dipole group mainly includes n1 T-shaped feed structures. Each T-shaped feed structure is formed by a horizontal chip conductor structure and a metal rodlike structure, where the horizontal chip conductor structure is loaded at the top, and the metal rodlike structure is vertically electrically connected to the horizontal chip conductor structure. In specific embodiments, the number n1 of the vertical electric dipoles, the rodlike structure and the chip structure may be optimized.

The horizontal magnetic dipole group includes several horizontal closed plane metal ring structures, or a cross-shaped conduction band structure connected to the ring structures described above, where each horizontal magnetic dipole mainly includes one or more layers of metal conduction bands; and each layer of metal conduction band may be formed by a closed plane metal ring, a dielectric filling material may be filled between the layers of metal conduction bands, and metal conduction bands may be electrically connected through a metal via.

The working process of the antenna is that: p1 excitation sources implement electromagnetic excitation on an electric dipole through a spatial structure loaded between the floor and the bottom of the T-shaped structure, the chip part of the T-shaped feed structures implements electromagnetic coupling with the horizontal magnetic dipoles through a dielectric, and under a joint action of the above two, electromagnetic energy radiation of the electromagnetic dipole is implemented.

A logical schematic diagram of the miniaturized electromagnetic dipole antenna involved in the present invention is shown in FIG. 10.

A low-profile mechanism of the antenna provided in the present invention is as follows: According to the duality principle of electromagnetic field, an image magnetic current of a horizontal magnetic dipole above a good conductor plane is in a same direction as a magnetic current (source magnetic current for short) of the horizontal magnetic dipole; therefore, electromagnetic fields, which are produced in a half-space where the excitation sources are located, may be characterized by a 2-element array formed by the source magnetic current and the image magnetic current thereof. When a spacing of the 2-element array is less than a half wavelength, that is, a spacing between the magnetic dipole and the good conductor is less than a quarter wavelength, the electromagnetic fields produced by the array described above are enhanced through superposition.

Therefore, by using a horizontal magnetic dipole above a good conductor, low profile can be implemented.

A wideband mechanism of the antenna provided in the present invention is as follows: A horizontal magnetic dipole formed by several horizontal closed plane metal rings or a cross-shaped conduction band connected to the ring structures described above is a multimode radiator, and each radiation mode of the multimode radiator corresponds to one resonance frequency, where half of the length of the circumference of one metal ring of the horizontal magnetic dipole corresponds to the minimum resonance frequency of the radiator, and half of the length of the cross-shaped conduction band connected to the ring structures described above corresponds to the maximum resonance frequency of the radiator. Therefore, on one hand, the horizontal magnetic dipole provided in the present invention can implement electromagnetic radiation at wide frequencies; and on the other hand, the vertical electric dipole may be regarded as a monopole antenna with the top subjected to electromagnetic loading, and used for transmitting and radiating electromagnetic waves. Because the loading effect is obvious, the electromagnetic coupling between the vertical electric dipole and the horizontal magnetic dipole is a main factor of energy transmission in the antenna. The electromagnetic coupling also has an effect of impedance changes between the vertical electric dipole and the horizontal magnetic dipole, thereby broadening impedance bandwidth of the antenna.

A +−45 degree dual polarization mechanism of the antenna provided in the present invention is as follows: In the present invention, four-port feed structures, which take a geometrical center point as a symmetrical center and sequentially have an angle difference of 90 degrees in the horizontal direction, is adopted, and an excitation mode where diagonal ports are a differential excitation port pair is adopted, thereby ensuring electromagnetic wave radiation of +−45 degree dual polarization.

A shape-preserving capacity mechanism of the antenna provided in the present invention is as follows: In order to further increase radiation pattern frequency bandwidth of the radiating unit, that is, increase radiation pattern shape-preserving capacity of the radiating unit, an octagonal metal patch with a central round hole is added at the top layer of an octagonal metal ring is adopted, so that a current path originally limited to the surface of the octagonal metal ring is increased to a current path on the surface of the octagonal metal ring and a current path on the octagonal metal patch, thereby increasing the number of current paths on the surface of the radiating unit, and promoting the enhancement of the radiation pattern shape-preserving capacity at different frequencies.

BRIEF DESCRIPTION OF THE DRAWINGS

To describe the technical solutions in the embodiments of the present invention more clearly, the following briefly introduces the accompanying drawings required for describing the embodiments or the prior art. Apparently, the accompanying drawings in the following description show merely some embodiments of the present invention, and a person of ordinary skill in the art may still derive other similar solutions from these accompanying drawings without creative efforts.

DETAILED DESCRIPTION

The following clearly and completely describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

The present invention designs an electromagnetic dipole antenna which can be applied to a wireless communication system such as a base station. The size of the antenna can be reduced to 65 mm×65 mm×23 mm, and the antenna can cover multiple bands such as 1.8 GHz, 2.1 GHz and 2.4 GHz.

Figure 1:
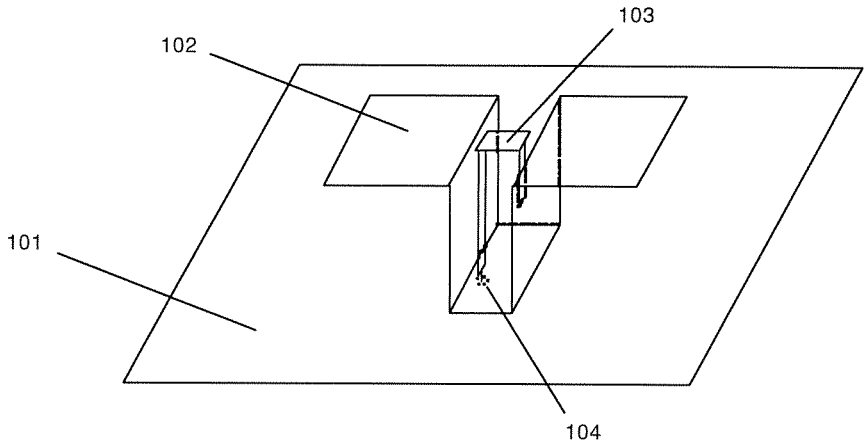
FIG. 1 (Prior Art)
FIG. 1 is a schematic diagram of an electromagnetic dipole antenna in the prior art.
Figure 2:
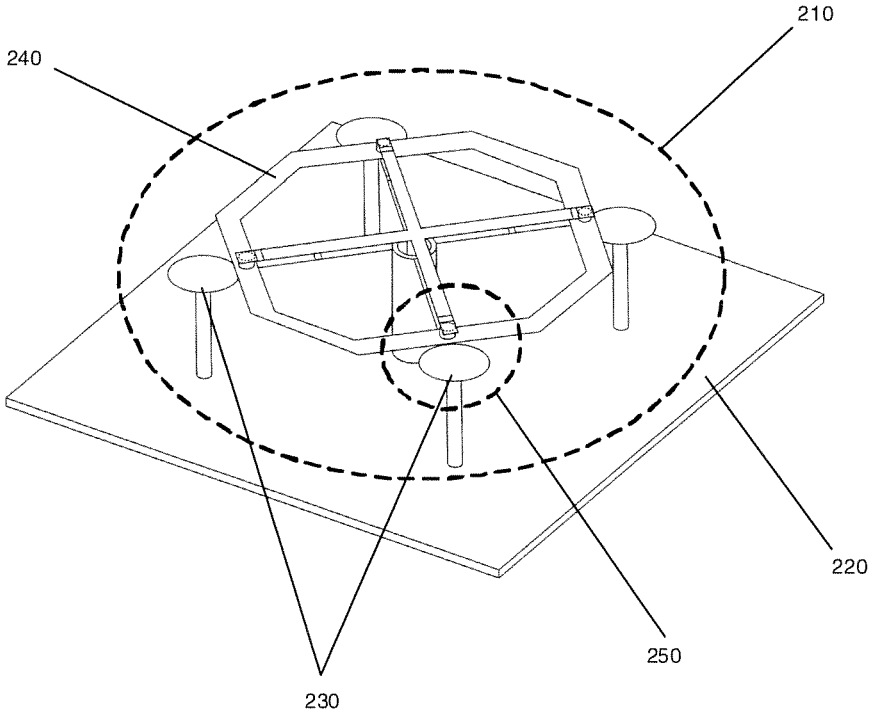
FIG. 2 is a physical schematic diagram of an electromagnetic dipole antenna according to an embodiment of the present invention.

FIG. 2 is a physical schematic diagram of an electromagnetic dipole antenna according to an embodiment of the present invention. As shown in FIG. 2, the electromagnetic dipole antenna according to an embodiment of the present invention includes an antenna radiating unit 210 and a metal ground 220. The antenna radiating unit 210 includes a vertical electric dipole group 230 and a horizontal magnetic dipole group 240. The vertical electric dipole group 230 and the horizontal magnetic dipole group 240 form an electromagnetic coupling structure 250.

The metal ground 220 is of a square plane structure, and may be 150 mm×150 mm×1 mm in size.

Figure 3:
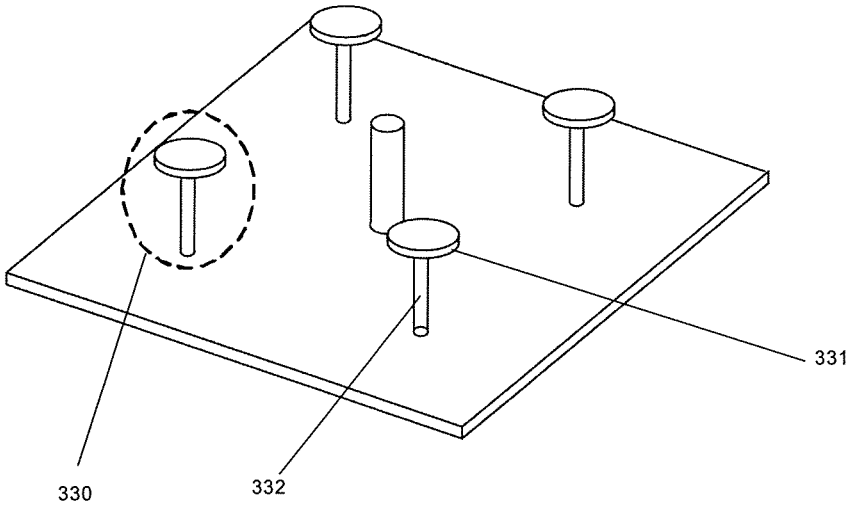
FIG. 3 is a schematic diagram of vertical electric dipoles according to an embodiment of the present invention.

FIG. 3 is a schematic diagram of vertical electric dipoles according to an embodiment of the present invention. A vertical electric dipole group formed by four vertical electric dipoles is shown in FIG. 3. Each vertical electric dipole is a T-shaped structure 330, and the T-shaped structure 330 is formed by a horizontal chip conductor structure 331 loaded at the top and a metal rodlike structure 332 electrically connected to the horizontal chip conductor structure 331. In the embodiment, the metal rodlike structure 332 may be a cylinder with a radius of 1.29 mm and a height of 17.6 mm.

The horizontal chip conductor structure 331 may be a disk with a radius of 5.3 mm and a thickness of 0.5 mm.

Figure 4:
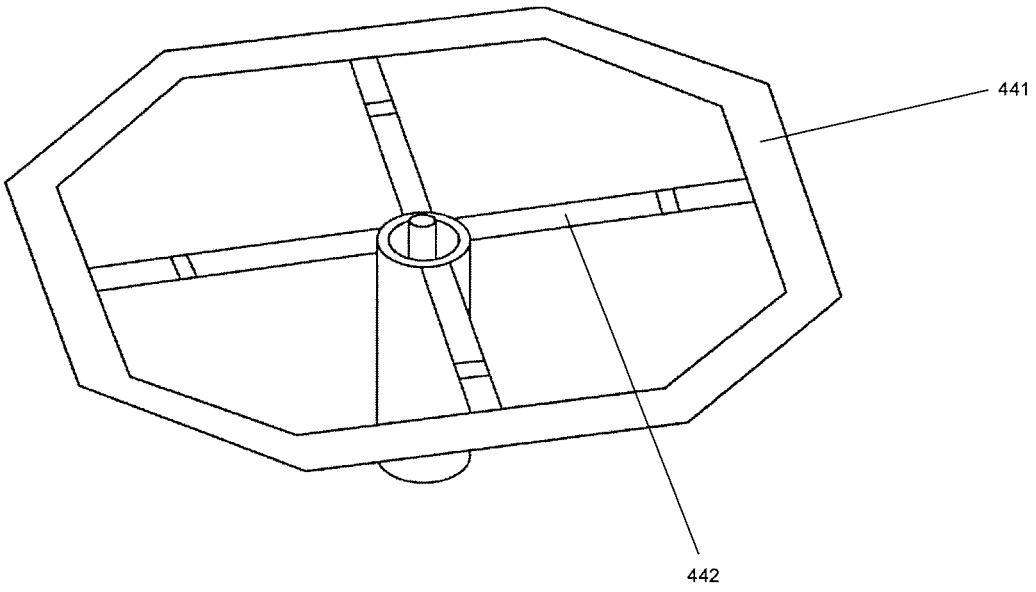
FIG. 4 is a schematic structural diagram of a horizontal magnetic dipole with an upper metal conduction band removed according to an embodiment of the present invention.

FIG. 4 is a schematic structural diagram of a horizontal magnetic dipole with an upper metal conduction band removed according to an embodiment of the present invention. As shown in FIG. 4, the horizontal magnetic dipole is of a horizontal closed plane metal ring structure. FIG. 4 shows only an octagonal metal ring 441 and a lower metal conduction band 442 of the horizontal magnetic dipole. The lower metal conduction band 442 is cross-shaped. The metal ring 441 is 27.4 mm in outer diameter and 3.64 mm in width.

Figure 5:
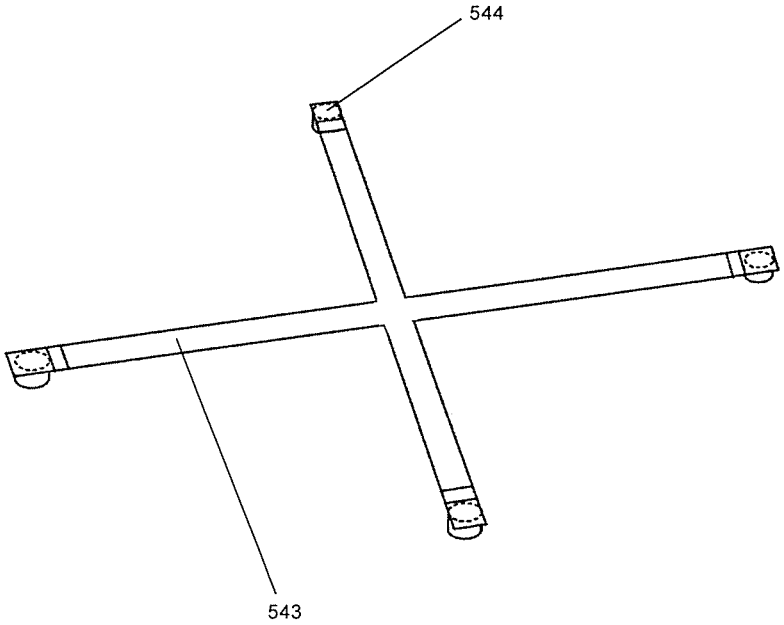
FIG. 5 is a schematic diagram of an upper metal conduction band on one horizontal magnetic dipole according to an embodiment of the present invention.

FIG. 5 is a schematic diagram of an upper metal conduction band on one horizontal magnetic dipole according to an embodiment of the present invention. As shown in FIG. 5, an upper metal conduction band 543 on the horizontal magnetic dipole is also a cross-shaped conduction band. A via 544 is disposed at the tail end of the upper metal conduction band 543, and the upper metal conduction band 543 is electrically connected to the metal ring 441 through the via 544. Referring to FIG. 2, a dielectric material with a dielectric constant of 2.55 is filled between the two layers of metal conduction bands.

Figure 6:
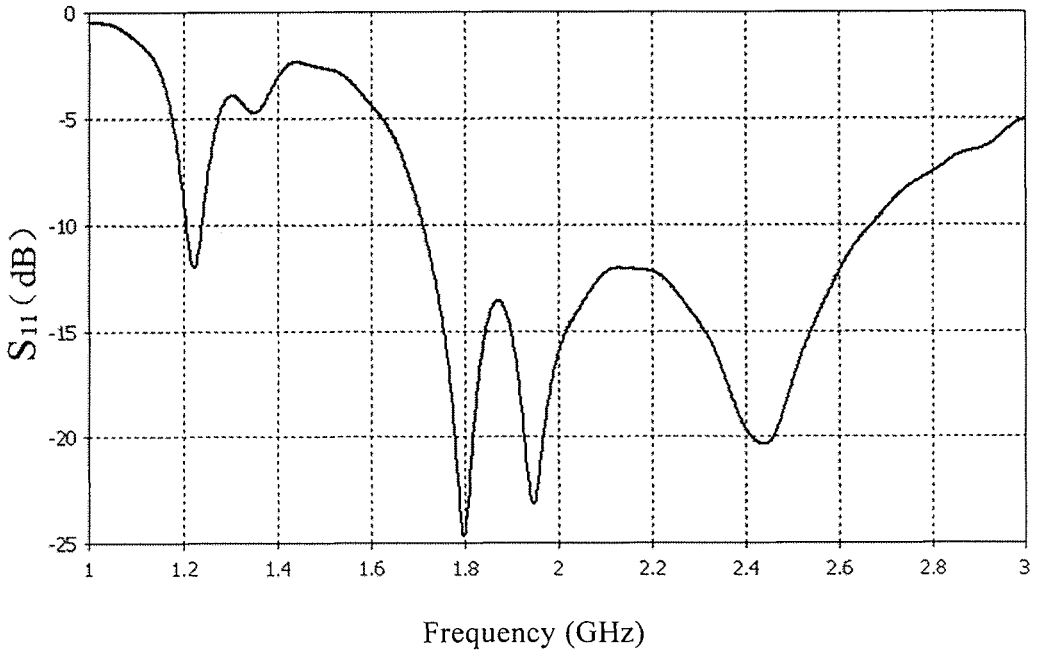
FIG. 6 is a standing-wave ratio curve of an electromagnetic dipole antenna according to an embodiment of the present invention.

The standing-wave ratio of the electromagnetic dipole antenna according to the embodiment: An S11 parameter curve is shown in FIG. 6. FIG. 6 is a standing-wave ratio curve of an electromagnetic dipole antenna according to an embodiment of the present invention, where the parameter is less than −10 dB at core frequencies such as 1.8 GHz, 2.1 GHz, and 2.4 GHz. The parameter can be adjusted to be less than −14 through a feed network, so as to meet requirements of a macro-cell base station antenna.

Figure 7:
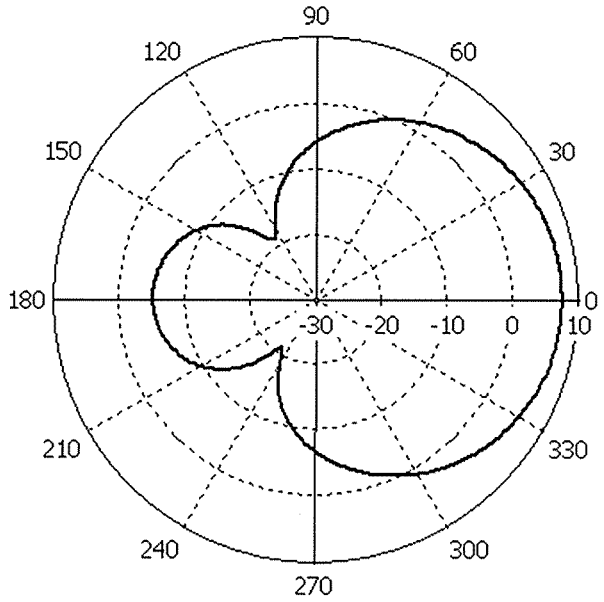
FIG. 7 is a gain radiation pattern of an electromagnetic dipole antenna at 1.8 GHz according to an embodiment of the present invention.
Figure 8:
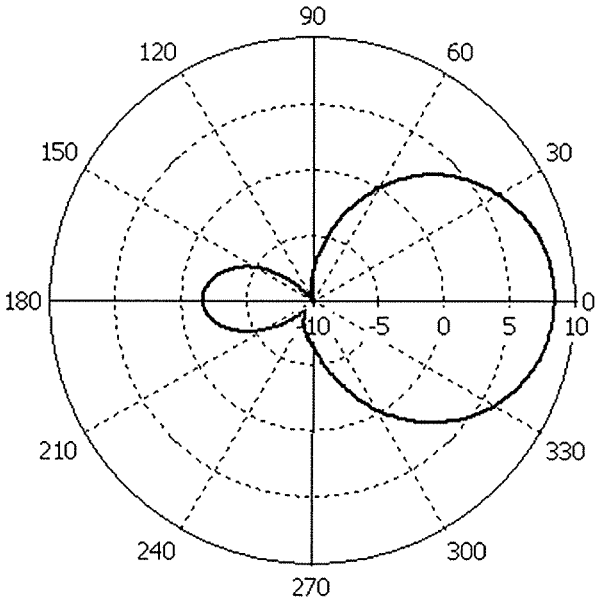
FIG. 8 is a gain radiation pattern of an electromagnetic dipole antenna at 2.1 GHz according to an embodiment of the present invention.
Figure 9:
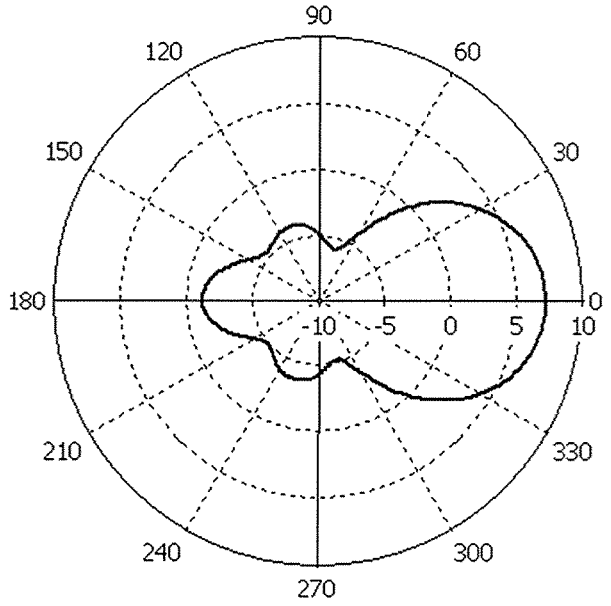
FIG. 9 is a gain radiation pattern of an electromagnetic dipole antenna at 2.4 GHz according to an embodiment of the present invention.

FIG. 7, FIG. 8 and FIG. 9 are gain radiation patterns of an electromagnetic dipole antenna at 1.8 GHz, 2.1 GHz and 2.4 GHz respectively according to an embodiment of the present invention, where FIG. 7 is a gain radiation pattern of an electromagnetic dipole antenna at 1.8 GHz according to an embodiment of the present invention, FIG. 8 is a gain radiation pattern of an electromagnetic dipole antenna at 2.1 GHz according to an embodiment of the present invention, and FIG. 9 is a gain radiation pattern of an electromagnetic dipole antenna at 2.4 GHz according to an embodiment of the present invention.

Figure 10:
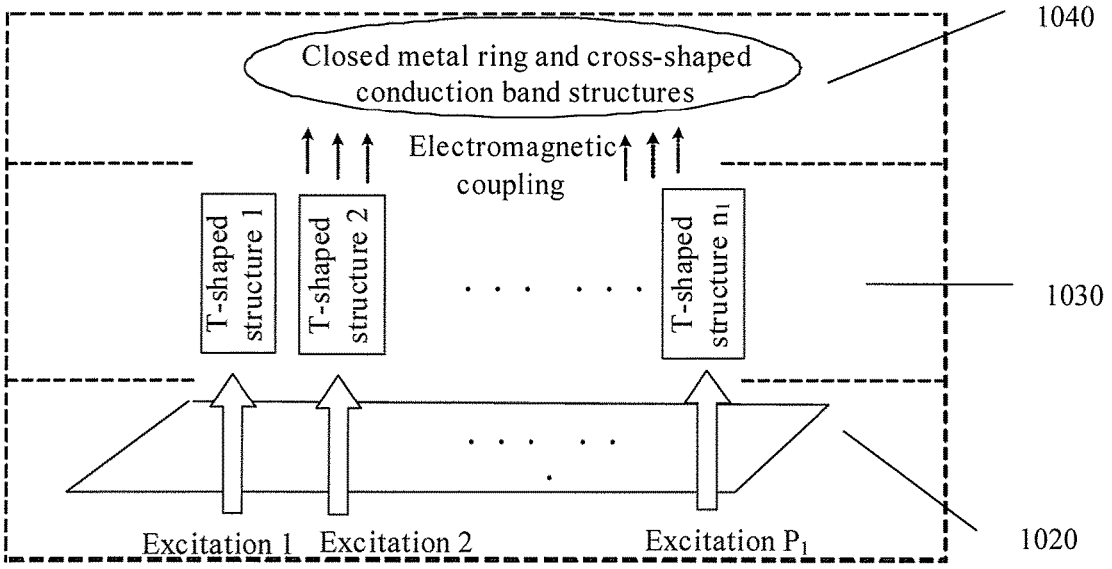
FIG. 10 is a schematic diagram of working principles of an electromagnetic dipole antenna.

FIG. 10 is a schematic diagram of working principles of an electromagnetic dipole antenna. FIG. 10 is a schematic diagram of working principles of an electromagnetic dipole antenna according to another embodiment of the present invention. A vertical electric dipole group 1030 mainly includes n1 T-shaped structures. In a specific implementation, the number n1 of the vertical electric dipoles may be properly adjusted. The shapes of the metal rodlike structure and the horizontal chip conductor structure may be properly adjusted.

A horizontal magnetic dipole group 1040 may include a metal ring and a metal conduction band, where the metal conduction band is cross-shaped. The metal ring may be formed by a layer of metal and may also be formed by multiple layers of metals, and a dielectric filling material may be filled between the layers of metals. One metal conduction band may include only a layer of metal and may also include two layers of metals or even multiple layers of metals, and a dielectric filling material may be filled between the layers of metals of the conduction band. The metal conduction band and the metal ring are electrically connected through vias.

The horizontal magnetic dipole group may be formed by multiple horizontal closed plane metal ring structures.

Electromagnetic coupling between the vertical electric dipole and the horizontal magnetic dipole is implemented through a dielectric. A metal ground may be of a planar structure and may also be a non-planar structure.

The working process of the antenna is as follows: p1 excitation sources implement electromagnetic excitation on electric dipoles by being loaded on a metal ground 1020 and a T-shaped structure, horizontal chip conductor structures of the T-shaped structure implement electromagnetic coupling with horizontal magnetic dipoles through a dielectric, and under a joint action of the above two, electromagnetic energy radiation of the electromagnetic dipole is implemented.

A person of ordinary skill in the art may understand that the structures disclosed herein are merely exemplary. Besides the content listed above, the structures can be appropriately changed according to the needs of specific applications. A person skilled in the art may use different structures for each specific application, but it should not be considered that the implementation goes beyond the scope of the present invention.

Although some embodiments of the present invention are shown and described, a person skilled in the art should understand that various modifications can be made to these embodiments without departing from the principle and spirit of the present invention, and all such modifications shall fall within the scope of the present invention.

What is claimed is:

1. An electromagnetic dipole antenna, comprising an antenna radiating unit, a metal ground, and a grounding conductor, wherein the antenna radiating unit comprises at least two T-shaped structures, a horizontal closed plane metal ring structure, and a metal conduction band electrically connected to the horizontal closed plane metal ring structure; wherein the T-shaped structure is formed by a horizontal chip conductor structure and a metal rodlike structure, and the metal rodlike structure is vertically electrically connected to the horizontal chip conductor structure;

the horizontal chip conductor structure is electromagnetically coupled with the horizontal closed plane metal ring structure and the metal conduction band;

the metal conduction band comprises a first metal conduction band and a second metal conduction band which are both cross-shaped; the second metal conduction band is electrically connected to the horizontal closed plane metal ring structure, and the first metal conduction band is electrically connected to the horizontal closed plane metal ring structure through four vias;

the grounding conductor comprises a first conductor and a second conductor; the first conductor connects the first metal conduction band to the metal ground; and the second conductor connects the second metal conduction band to the metal ground.

* * * * *